US011813730B2

(12) United States Patent
Chang

(10) Patent No.: US 11,813,730 B2
(45) Date of Patent: Nov. 14, 2023

(54) SOCKET HOLDER

(71) Applicant: CHUN NIEN PLASTIC LTD., Taichung (TW)

(72) Inventor: Chi-Tsai Chang, Taichung (TW)

(73) Assignee: CHUN NIEN PLASTIC LTD., Taichung (TW)

( * ) Notice: Subject to any disclaimer, the term of this patent is extended or adjusted under 35 U.S.C. 154(b) by 0 days.

(21) Appl. No.: 18/073,943

(22) Filed: Dec. 2, 2022

(65) Prior Publication Data

US 2023/0219209 A1 Jul. 13, 2023

(30) Foreign Application Priority Data

Jan. 12, 2022 (TW) ..... 111200413

(51) Int. Cl.
*B25H 3/00* (2006.01)

(52) U.S. Cl.
CPC ..... *B25H 3/003* (2013.01)

(58) Field of Classification Search
CPC . B25H 3/003; B25H 3/00; B25H 3/04; B25H 3/06
USPC ..... 81/438; 403/361; 206/378, 349, 493, 206/376, 379, 377; 211/70.6, 49.1, 69
See application file for complete search history.

(56) References Cited

U.S. PATENT DOCUMENTS 5,467,874 A * 11/1995 Whitaker ..... B25H 3/06 248/309.2
7,152,747 B2 * 12/2006 Wang ..... A47F 5/0006 211/70.6
7,374,042 B2 * 5/2008 Liu ..... B25H 3/003 206/372
9,782,890 B2 * 10/2017 Hsieh ..... B25H 3/04
11,007,625 B2 * 5/2021 Chen ..... B25B 23/0028
11,090,799 B2 * 8/2021 Wang ..... B25H 3/003
11,420,320 B2 * 8/2022 Chang ..... B25H 3/003
2003/0150824 A1 * 8/2003 McNeely ..... B25H 3/003 206/378
2005/0218023 A1 * 10/2005 Winnard ..... B25H 3/003 206/378
2005/0221664 A1 * 10/2005 Winnard ..... B25H 3/003 439/510

(Continued)

FOREIGN PATENT DOCUMENTS

TW I519393 B 2/2016

*Primary Examiner* — Steven A. Reynolds
*Assistant Examiner* — Prince Pal
(74) *Attorney, Agent, or Firm* — Muncy, Geissler, Olds & Lowe

(57) ABSTRACT

A socket holder is provided, including: a first member, including a base and a post, the post being connected to the base and extending in an axial direction; a second member, configured for assembling of a socket including a positioning hole, sleeved on the post and movable between a release position and a lock position relative to the first member in the axial direction; and a detent member, disposed between the first member and the second member; wherein when the second member is located in release position, the socket is movable relative to the second member in the axial direction; when the socket is sleeved on the second member and the second member is located in lock position, the detent member is protrusive beyond the second member and at least partially engaged within the positioning hole so that the socket is positioned to the second member.

9 Claims, 9 Drawing Sheets

(56) References Cited

U.S. PATENT DOCUMENTS

| | | | | |
|---|---|---|---|---|
| 2007/0012587 | A1* | 1/2007 | Wang | B25H 3/003 206/349 |
| 2010/0065520 | A1* | 3/2010 | Hsieh | B25H 3/06 211/70.6 |
| 2011/0089126 | A1* | 4/2011 | Hsieh | B25H 3/06 211/70.6 |
| 2018/0209483 | A1* | 7/2018 | Yu | B25B 23/0014 |
| 2019/0091842 | A1* | 3/2019 | Chou | B25B 13/06 |
| 2020/0072294 | A1* | 3/2020 | Chen | F16D 3/20 |
| 2020/0101590 | A1* | 4/2020 | Winnard | A61K 39/12 |
| 2021/0060761 | A1* | 3/2021 | Chang | B25H 3/003 |

* cited by examiner

SOCKET HOLDER

BACKGROUND OF THE INVENTION

Field of the Invention

The present invention relates to a socket holder.

Description of the Prior Art

For the convenience of carrying, the socket is usually stored on a socket holder, and the socket holder is provided with a positioning device to position the socket to prevent the socket from falling off easily.

The conventional socket holder, such as the device disclosed in TW 1519393, includes a carrier and a positioning member disposed on the carrier. The positioning member includes an elastic buckle structure, the elastic buckle structure is configured to be inserted in a connection hole of the socket, and the outer wall of at least one elastic arm of the elastic buckle structure includes a protrusion. When at least one end of the positioning member moves relative to the carrier along a track, the elastic buckle structure can project outward or retract inward so that the protrusion can engage within or disengage from a detent hole on an inner surface of the socket.

However, it needs a hand to position the carrier and the other hand to rotate the positioning member when the conventional hand tool positioning device is altered to be in a lock mode or a release mode by rotation, which cannot be carried out operation with one hand and it is therefore inconvenient.

The present invention is, therefore, arisen to obviate or at least mitigate the above-mentioned disadvantages.

SUMMARY OF THE INVENTION

The main object of the present invention is to provide a socket holder which is quickly to be locked or released by easy operation of pressing.

To achieve the above and other objects, a socket holder is provided, including: a first member, including a base and a post, the post being connected to the base and extending in an axial direction; a second member, configured for assembling of a socket including a positioning hole, sleeved on the post and movable between a release position and a lock position relative to the first member in the axial direction; and a detent member, disposed between the first member and the second member; wherein when the second member is located in release position, the socket is movable relative to the second member in the axial direction; when the socket is sleeved on the second member and the second member is located in lock position, the detent member is protrusive beyond the second member and at least partially engaged within the positioning hole so that the socket is positioned to the second member.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
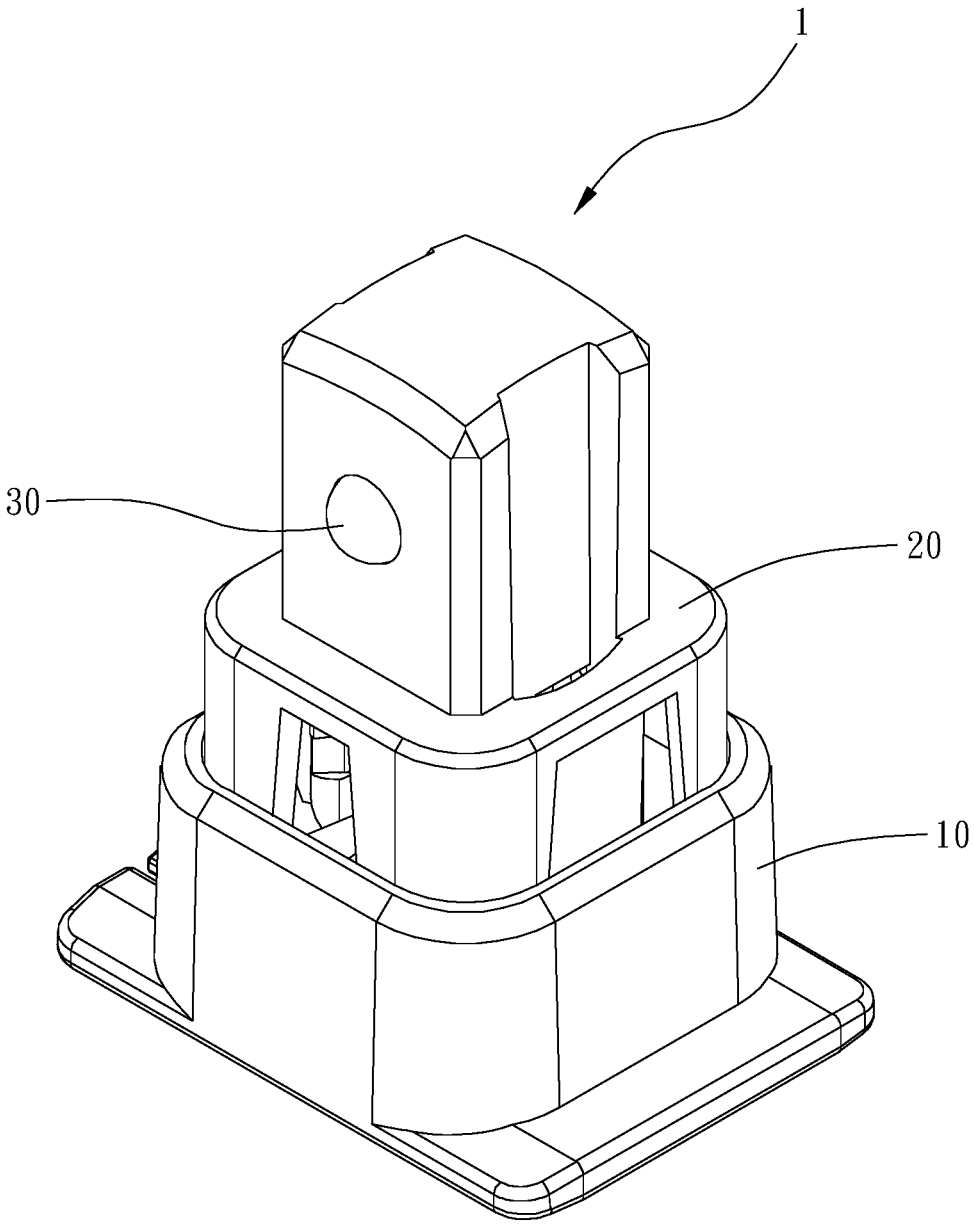
FIG. 1 is a stereogram of a preferable embodiment of the present invention.
Figure 2:
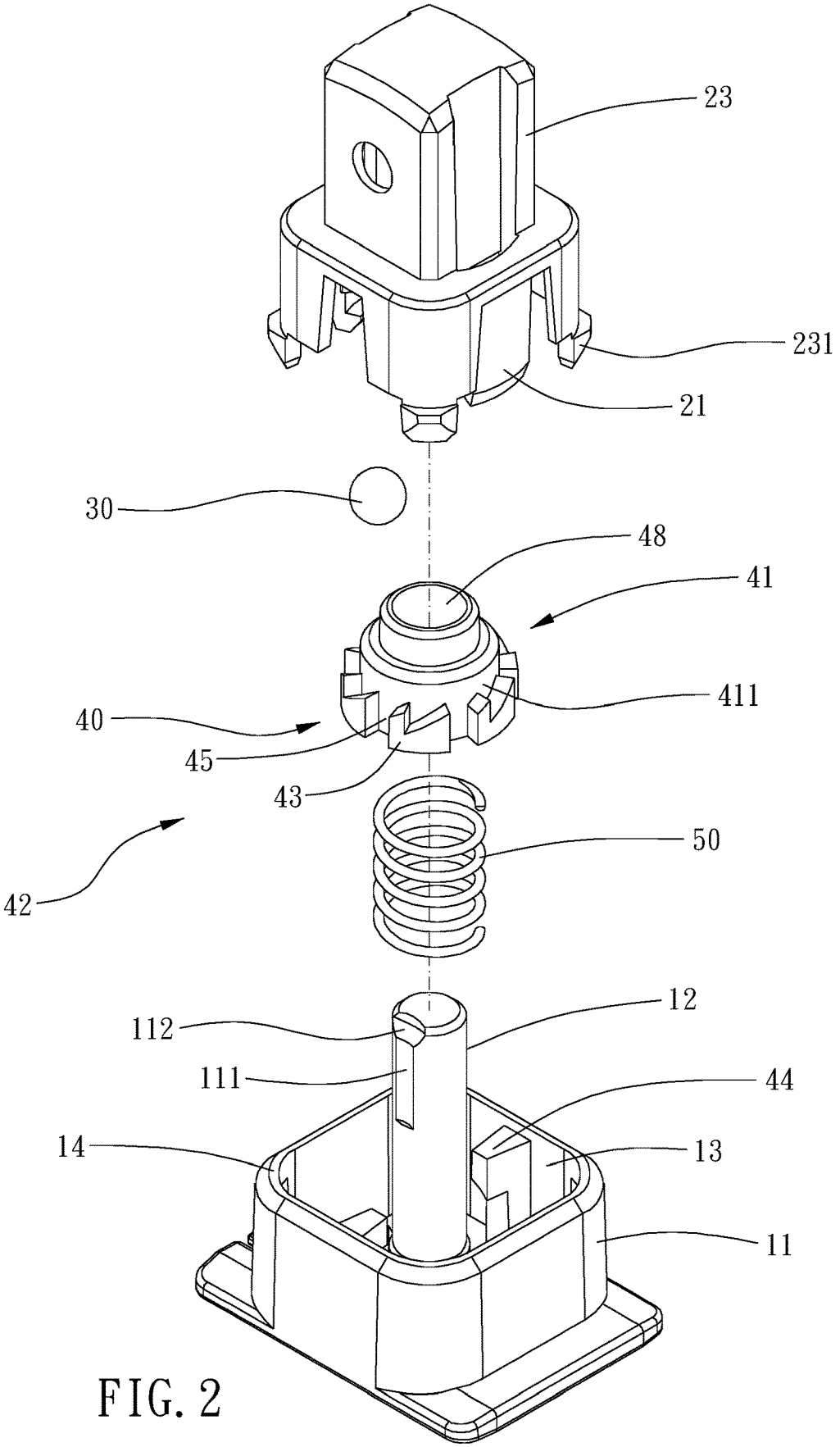
FIG. 2 is a perspective breakdown drawing of a preferable embodiment of the present invention.
Figure 3:
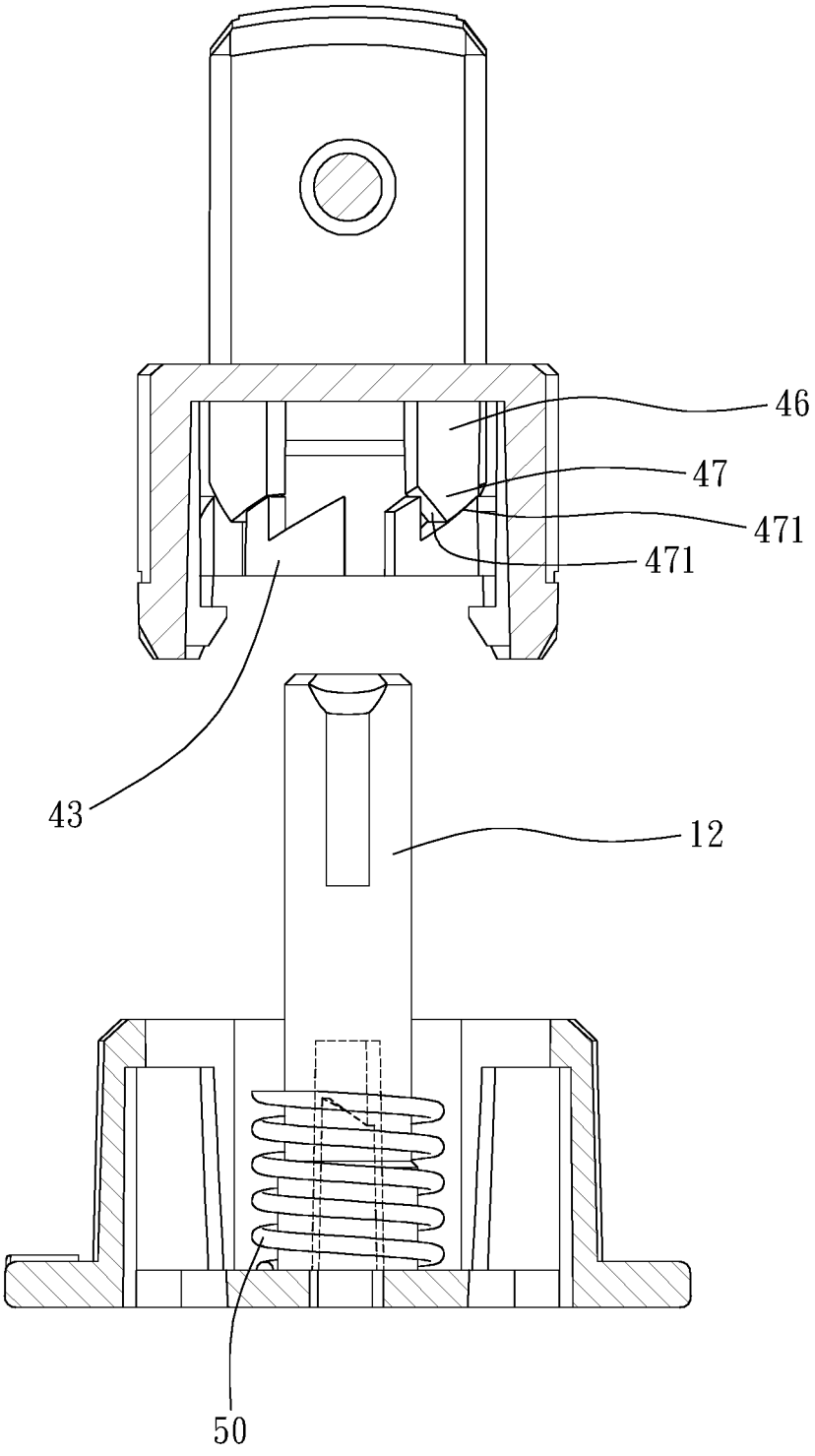
FIG. 3 is a cross-sectional breakdown drawing of a preferable embodiment of the present invention.

Please refer to FIGS. 1 to 9 for a preferable embodiment of the present invention. A socket holder 1 of the present invention includes a first member 10, a second member 20 and a detent member 30.

The first member 10 includes a base 11 and a post 12, and the post 12 is connected to the base 11 and extends in an axial direction A. The second member 20 is configured for assembling of a socket 2 including a positioning hole 3, and the second member 20 is sleeved on the post 12 and movable between a release position and a lock position relative to the first member 10 in the axial direction A. The detent member 30 is disposed between the first member 10 and the second member 20. In this embodiment, the detent member 30 is a ball member; however, the detent member may be an elastic arm integrally formed on the second member. When the second member 20 is located in release position, the socket 2 is movable relative to the second member 20 in the axial direction A. When the socket 2 is sleeved on the second member 20 and the second member 20 is located in lock position, the detent member 30 is protrusive beyond the second member 20 and at least partially engaged within the positioning hole 3 so that the socket 2 is positioned to the second member 20. As such, it is quickly to lock or release the socket 2 by easy operation of pressing.

The socket holder 1 further includes a positioning mechanism 40 and an elastic member 50, and the positioning mechanism 40 includes a rotatable member 41 and a limitation structure 42. The rotatable member 41 is disposed between the first member 10 and the second member 20, and the elastic member 50 is disposed between the rotatable member 41 and the first member 10. The limitation structure 42 includes at least one first limit unit 43 and at least one second limit unit 44, each of the at least one first limit unit 43 is disposed on the rotatable member 41, and each of the at least one second limit unit 44 is disposed on the first member 10. The rotatable member 41 can be driven by the second member 20 to move in the axial direction A and rotate relative to the second member 20 and the first member 10 so that the at least one first limit unit 43 blocks the at least one second limit unit 44 in the axial direction A or is offset relative to each of the at least one second limit unit 44 in the axial direction A. Specifically, the limitation structure 42 includes a plurality of dodge spaces 45 and a plurality of said first limit units 43, and the plurality of dodge spaces 45 and the plurality of said first limit units 43 are alternatively arranged around an outer surface 411 of the rotatable member 41. The rotatable member 41 is configured to rotate so that one of the plurality of said first limit units 43 corresponds to the at least one second limit unit 44 or one of the plurality of dodge spaces 45 corresponds to the at least one second limit unit 44, which allows each of the at least one second limit unit 44 to disengageably move into one of the plurality of dodge spaces 45. Each of the at least one first limit unit 43 is a protrusion protruding beyond the outer surface 411 of the rotatable member 41, and each of the at least one second limit unit 44 is a protrusion protruding beyond an inner surface of the first member 10. In this embodiment, the at least one second limit unit includes two second limit units 44, the two second limit units 44 are disposed on opposing sides of the first member 10.

The positioning mechanism 40 further includes a projection 46, the projection 46 is disposed on the second member 20, and the projection 46 includes at least one tooth end portion 47. In this embodiment, the projection 46 includes a plurality of said tooth end portions 47 disposed around the second member 20. Each of the at least one tooth end portion 47 extends in the axial direction A, a side of each of the at least one first limit unit 43 facing toward the projection 46 includes a groove 431 and a tooth 432, and the at least one tooth end portion 47 is blockable within the groove 431 or by the tooth 432. In this embodiment, the groove 431 includes a bevel 433 and a lateral surface 434 transverse to the bevel 433, each of the at least one tooth end portion 47 is V-shaped, and each of the at least one tooth end portion 47 includes two inclined surfaces 471 arranged symmetrically. One of the two inclined surfaces 471 is abutable against the bevel 433, and the other of the two inclined surfaces 471 is abutable laterally against the lateral surface 434. Each of the at least one tooth end portion 47 is disengeably abutable against the tooth 432 or the groove 431 of one of the plurality of said first limit units 43 so that it is easy to rotate the rotatable member 41 and move the rotatable member 41 in the axial direction A by pressing the second member 20 in the axial direction A.

Figure 4:
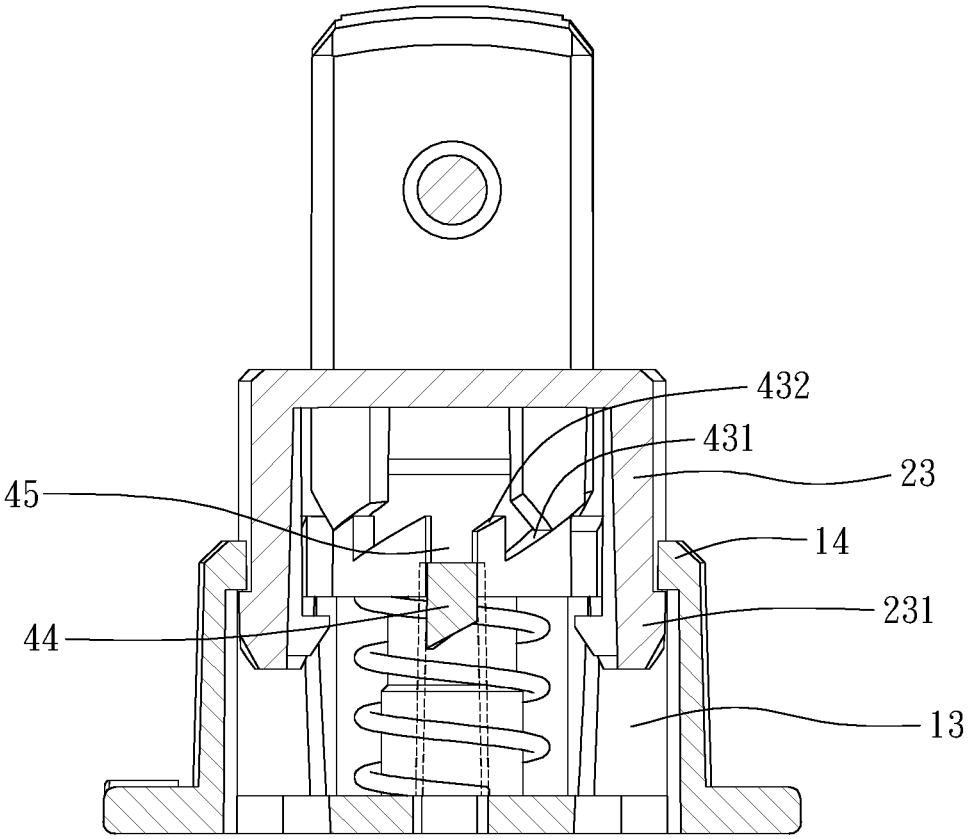
FIG. 4 is a drawing showing a socket holder in a release position according to a preferable embodiment of the present invention.
Figure 5:
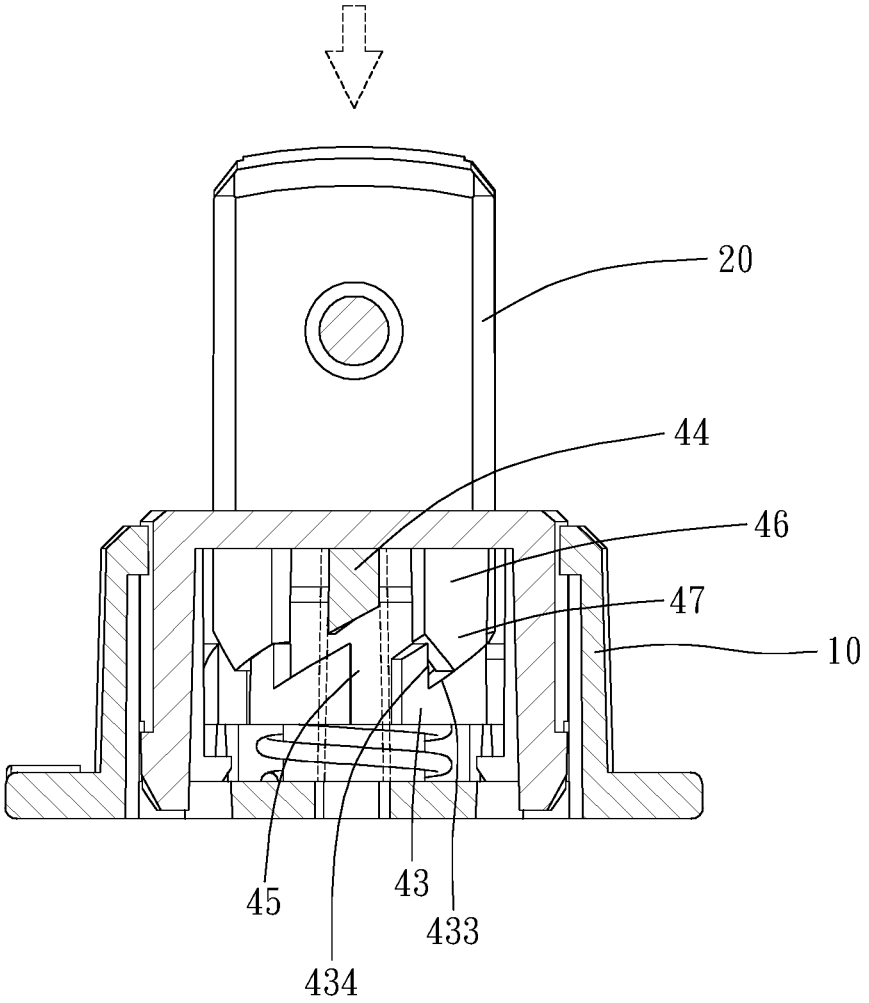
FIG. 5 is a drawing showing a second member pressed according to a preferable embodiment of the present invention.
Figure 6:
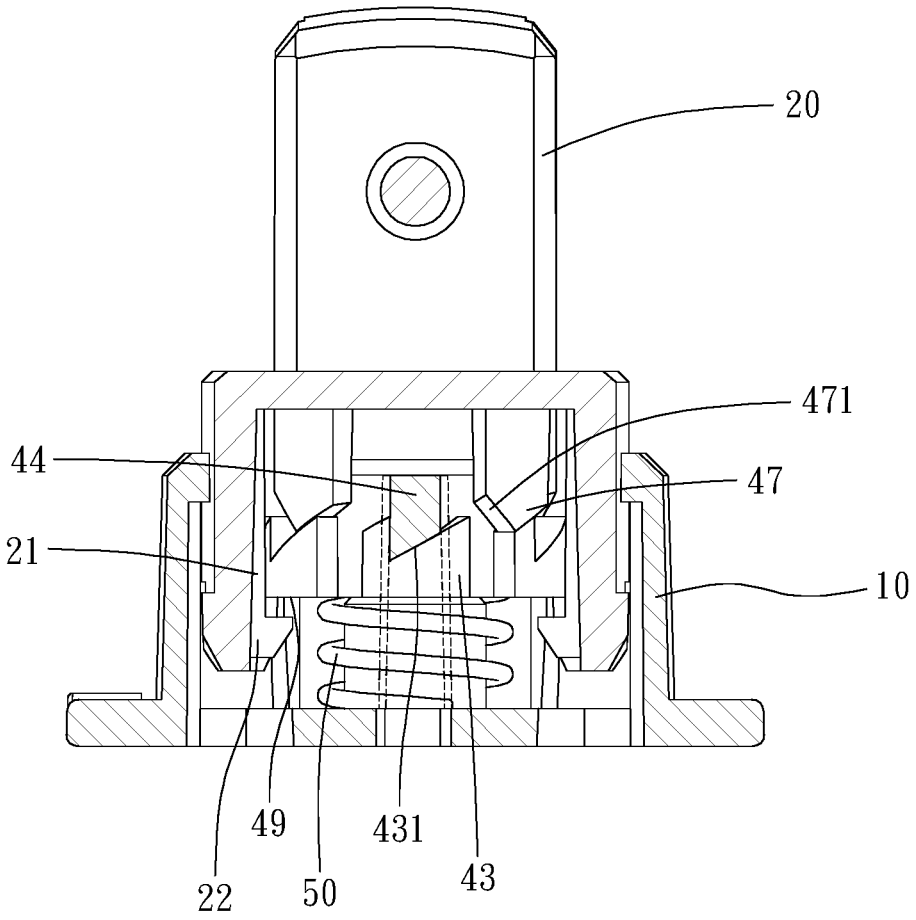
FIG. 6 is a drawing showing the socket holder in a lock position according to a preferable embodiment of the present invention.
Figure 7:
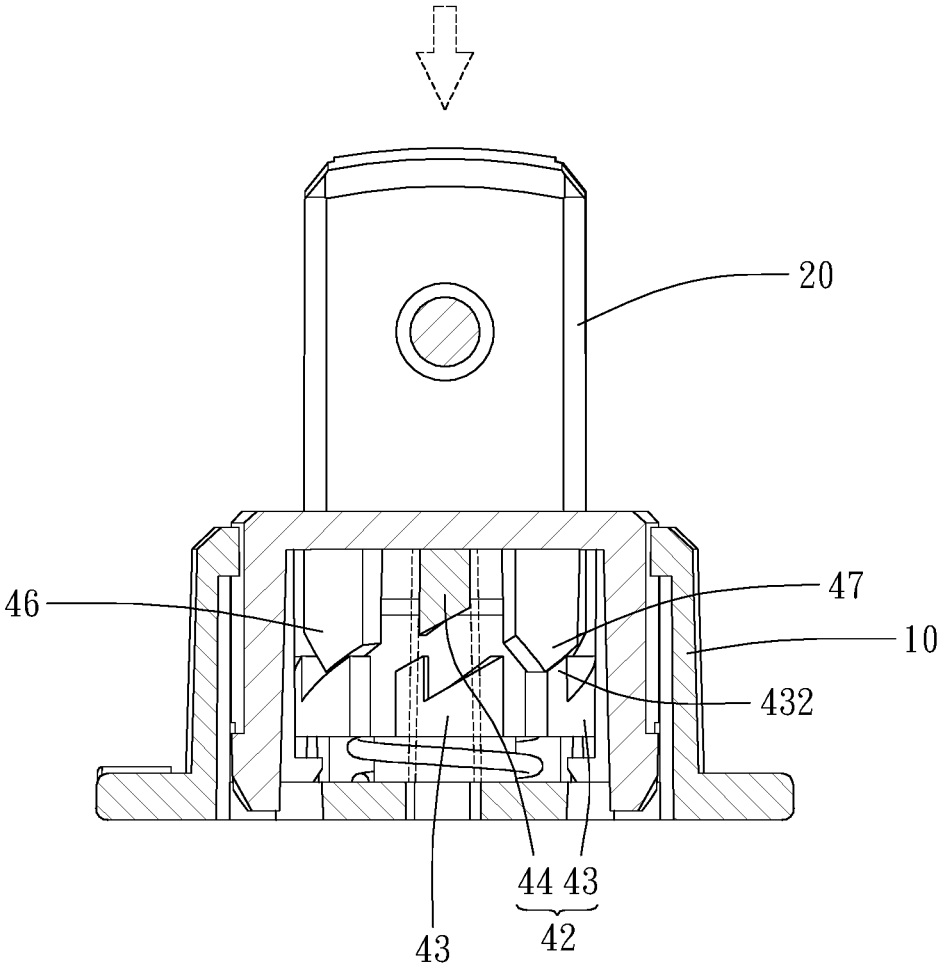
FIG. 7 is another drawing showing the second member pressed according to a preferable embodiment of the present invention.
Figure 8:
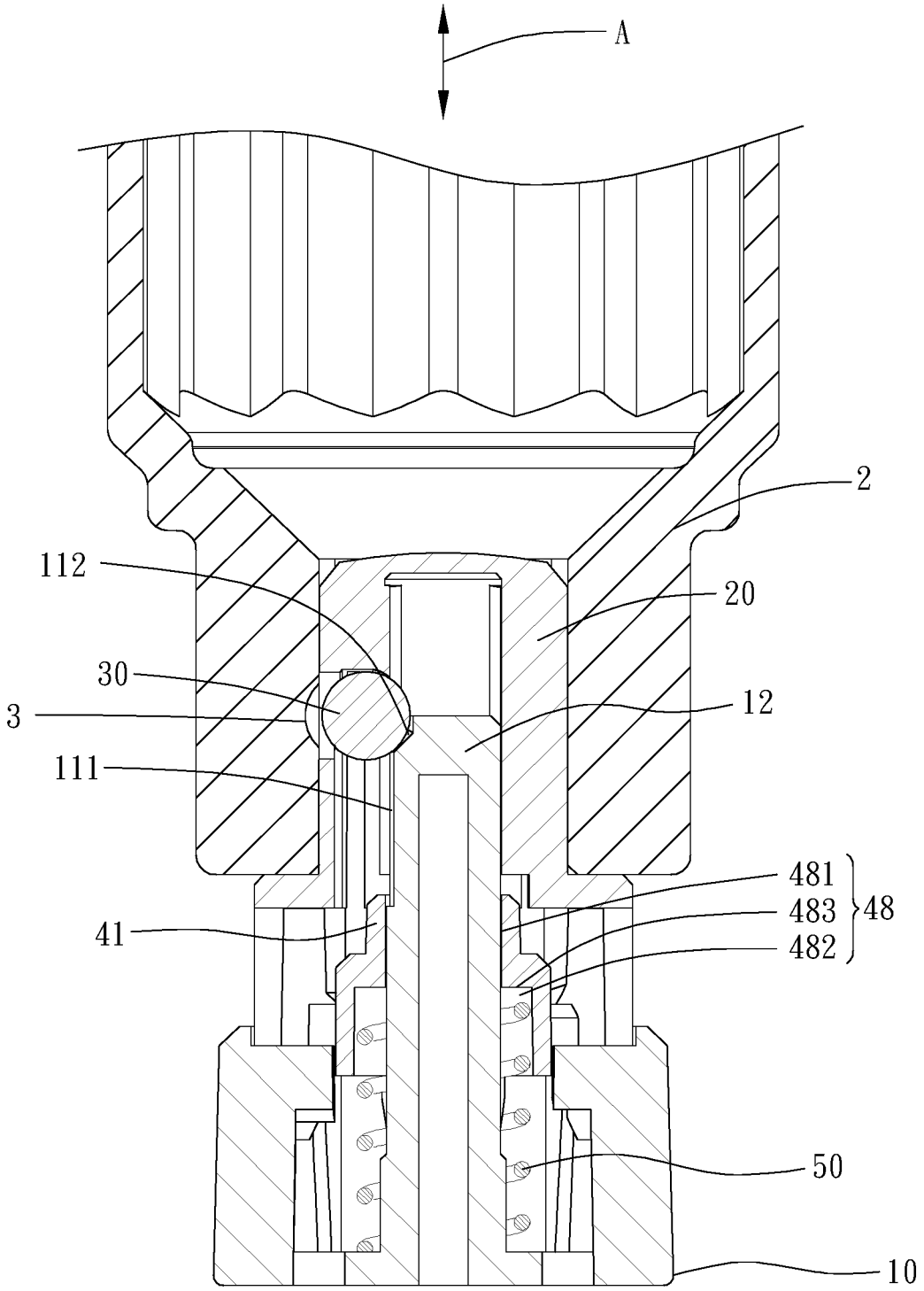
FIG. 8 is another drawing showing the socket holder in the release position according to a preferable embodiment of the present invention.
Figure 9:
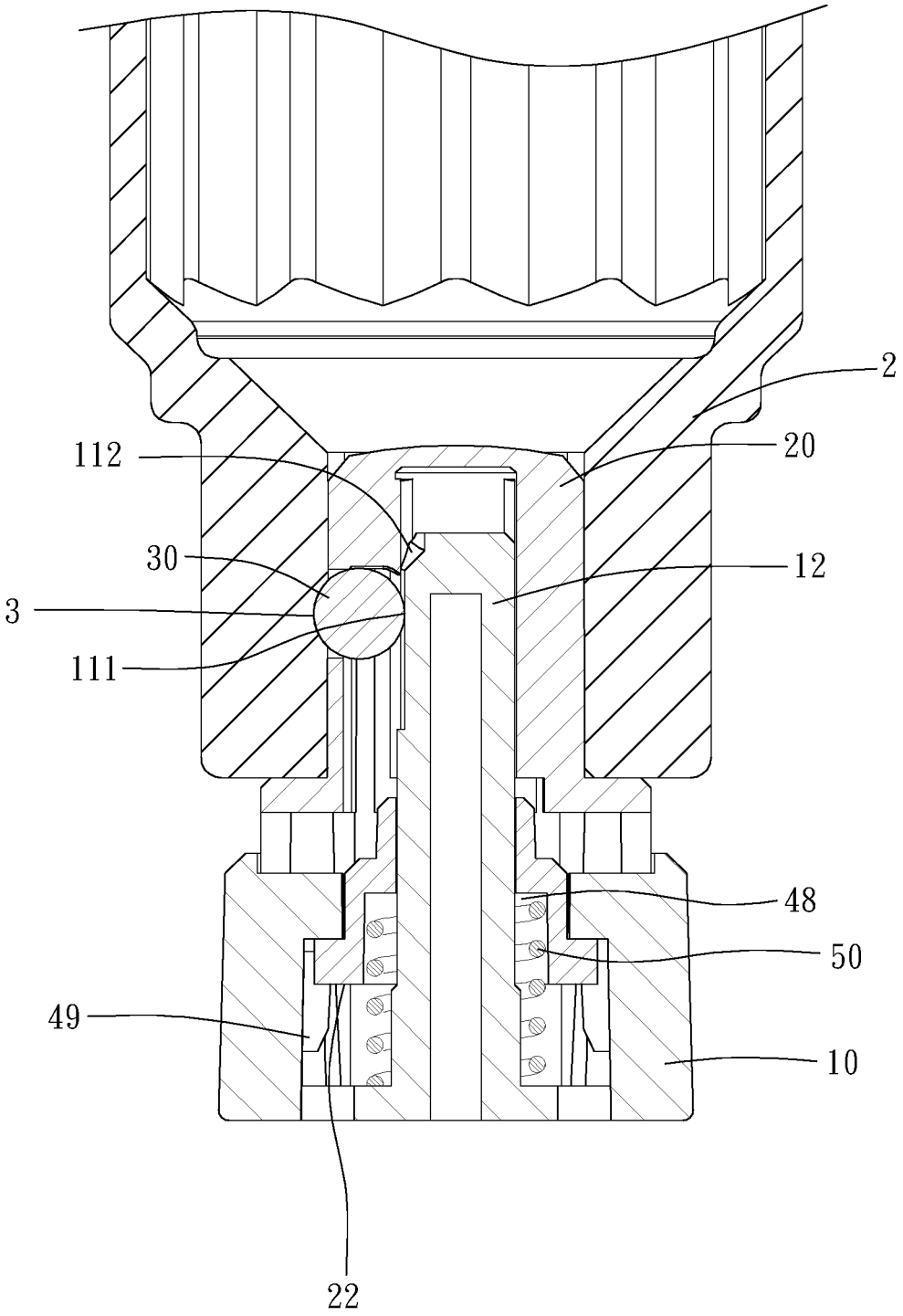
FIG. 9 is another drawing showing the socket holder in the lock position according to a preferable embodiment of the present invention.

The rotatable member 41 is movable relative to the first member 10 in the axial direction A to be in a first position, a second position or a third position. As shown in FIG. 4, when the rotatable member 41 is located in the first position, the at least one first limit unit 43 and the at least one second limit unit 44 are relatively offset in the axial direction A and rotationally blocked with each other, the rotatable member 41 can move only in the axial direction A and cannot rotate. As shown in FIGS. 4, 5 and 7, when the rotatable member 41 is located in the second position, the at least one first limit unit 43 and the at least one second limit unit 44 are not rotationally blocked with each other, the rotatable member 41 can move in the axial direction A and rotate; As shown in FIG. 6, when the rotatable member 41 is located in the third position, the at least one first limit unit 43 and the at least one second limit unit 44 are axially and rotationally blocked with each other, one of the at least one second limit unit 44 is blocked within the groove 431.

The rotatable member 41 includes a through hole 48, the post 12 is disposed in the through hole 48, the through hole 48 includes a small diameter section 481, a larger diameter section 482 and a shoulder 483 between the small diameter section 481 and the larger diameter section 482, and the elastic member 50 is disposed through the larger diameter section 482 and abutted against the shoulder 483. As such, the rotatable member 41 can move in the axial direction A stably, and the elastic member 50 can be pressed by the rotatable member 41 for urging the rotatable member 41 to restore.

The second member 20 includes an elastic arm 21 and a first blocking portion 22, the elastic arm 21 includes the first blocking portion 22, the rotatable member 41 includes a second blocking portion 49, and the first blocking portion 22 and the second blocking portion 49 are disengageably blocked with each other in the axial direction A. In this embodiment, the second blocking portion 49 is a lower portion of the rotatable member 41, the first blocking portion 22 is hook-shaped, and the first blocking portion 22 can be hooked with the second blocking portion 49, which avoids over-movement of the second member 20 in the axial direction A. In addition, the second member 20 can urge the elastic arm 21 to deform (swing, for example) so that the first blocking portion 22 disengages from the second blocking portion 49.

The second member 20 includes at least one elastic blocking portion 23, and each of the at least one elastic blocking portion 23 is swingable relative to the second member 20. A side of each of the at least one elastic blocking portion 23 facing away the post 12 includes a blocking member 231, the base 11 includes a receiving room 13 and a flange 14, the flange 14 (may be annular) extends to be within the receiving room 13, each of the at least one elastic blocking portion 23 is disposed in the receiving room 13, and the blocking member 231 of each of the at least one elastic blocking portion 23 is blocked with the flange 14 in the axial direction A, so that the second member 20 is not easy to disengage from the first member 10. Each of the at least one elastic blocking portion 23 may be deformed (swing, for example) relative to the flange 14 to disengage the second member 20 from the receiving room 13 or engage the second member 20 into the receiving room 13 quickly.

The post 12 includes a blocking wall 111 and a recess 112, and the blocking wall 111 and the recess 112 are arranged in the axial direction A. When the second member 20 is located in release position, the recess 112 corresponds to the detent member 30, and the detent member 30 is at least partially received in the recess 112. When the second member 20 is located in lock position, the blocking wall 111 urges the detent member 30. As such, the socket 2 can be unlocked or locked.

In operation, when the second member 20 is located in release position (FIG. 4), it is to press the second member 20 to move the inclined surface 471 to urge the bevel 433 so that the rotatable member 41 is driven to press the elastic member 50 and release rotational blocking of each of the at least one first limit unit 43 and the second limit unit 44 (FIG. 5); as the second member 20 is released, the elastic member 50 pushes the rotatable member 41 upwardly to engage the second blocking portion 49 into the groove 431 so that the second member 20 is located in lock position (FIG. 6); the second member 20 is pressed, the bevel 433 urges the tooth 432 so that each of the at least one first limit unit 43 and the second limit unit 44 are disengaged from each other and the rotatable member 41 is rotatable; and after the second member 20 is released, the elastic member 50 pushes the rotatable member 41 upwardly so that the rotatable member 41 drives the second member 20 to be in the release position (FIG. 4). As a result, it is easy and quick to lock the socket 2 to the second member 20 or release the socket 2 from the second member 20 by pressing the second member 20.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A socket holder, including:

a first member, including a base and a post, the post being connected to the base and extending in an axial direction;

a second member, configured for assembling of a socket including a positioning hole, sleeved on the post and movable between a release position and a lock position relative to the first member in the axial direction;

a detent member, disposed between the first member and the second member; and a positioning mechanism and an elastic member;

wherein when the second member is located in release position, the socket is movable relative to the second member in the axial direction; when the socket is sleeved on the second member and the second member is located in lock position, the detent member is protrusive beyond the second member and at least partially engaged within the positioning hole so that the socket is positioned to the second member;

wherein the positioning mechanism includes a rotatable member and a limitation structure, the rotatable member is disposed between the first member and the second member, the elastic member is disposed between the rotatable member and the first member, the limitation structure includes at least one first limit unit and at least one second limit unit, each of the at least one first limit unit is disposed on the rotatable member, each of the at least one second limit unit is disposed on the first member, and the rotatable member can be driven by the second member to move in the axial direction and rotate relative to the second member and the first member so that the at least one first limit unit blocks the at least one second limit unit in the axial direction or is offset relative to each of the at least one second limit unit in the axial direction.

2. The socket holder of claim 1, wherein the limitation structure further includes a plurality of dodge spaces and a plurality of said first limit units, the plurality of dodge spaces and the plurality of said first limit units are alternatively arranged around an outer surface of the rotatable member, and the rotatable member is configured to rotate so that one of the plurality of said first limit units corresponds to the at least one second limit unit or one of the plurality of dodge spaces corresponds to the at least one second limit unit, which allows each of the at least one second limit unit to disengageably move into one of the plurality of dodge spaces.

3. The socket holder of claim 1, wherein the rotatable member is movable relative to the first member in the axial direction to be in a first position, a second position or a third position, when the rotatable member is located in the first position, the at least one first limit unit and the at least one second limit unit are relatively offset in the axial direction and rotationally blocked with each other; when the rotatable member is located in the second position, the at least one first limit unit and the at least one second limit unit are not rotationally blocked with each other; when the rotatable member is located in the third position, the at least one first limit unit and the at least one second limit unit are axially and rotationally blocked with each other.

4. The socket holder of claim 1, wherein the positioning mechanism further includes a projection, the projection is disposed on the second member, the projection includes at least one tooth end portion, each of the at least one tooth end portion extends in the axial direction, a side of each of the at least one first limit unit facing toward the projection includes a groove and a tooth, and the at least one tooth end portion is blockable within the groove or by the tooth alternatively.

5. The socket holder of claim 1, wherein the rotatable member includes a through hole, the post is disposed in the through hole, the through hole includes a small diameter section, a larger diameter section and a shoulder between the small diameter section and the larger diameter section, and the elastic member is disposed through the larger diameter section and abutted against the shoulder.

6. The socket holder of claim 1, wherein the second member includes an elastic arm and a first blocking portion, the elastic arm includes the first blocking portion, the rotatable member includes a second blocking portion, and the first blocking portion and the second blocking portion are disengageably blocked with each other in the axial direction.

7. A socket holder, including:

a first member, including a base and a post, the post being connected to the base and extending in an axial direction;

a second member, configured for assembling of a socket including a positioning hole, sleeved on the post and movable between a release position and a lock position relative to the first member in the axial direction; and a detent member, disposed between the first member and the second member;

wherein when the second member is located in release position, the socket is movable relative to the second member in the axial direction; when the socket is sleeved on the second member and the second member is located in lock position, the detent member is protrusive beyond the second member and at least partially engaged within the positioning hole so that the socket is positioned to the second member;

wherein the second member includes at least one elastic blocking portion, each of the at least one elastic blocking portion is swingable relative to the second member, a side of each of the at least one elastic blocking portion facing away the post includes a blocking member, the base includes a receiving room and a flange, the flange extends to be within the receiving room, each of the at least one elastic blocking portion is disposed in the receiving room, and the blocking member of each of the at least one elastic blocking portion is blocked with the flange in the axial direction.

8. The socket holder of claim 1, wherein the post includes a blocking wall and a recess, the blocking wall and the recess are arranged in the axial direction; when the second member is located in release position, the recess corresponds to the detent member, and the detent member is at least partially received in the recess; when the second member is located in lock position, the blocking wall urges the detent member.

9. The socket holder of claim 3, wherein the limitation structure further includes a plurality of dodge spaces and a plurality of said first limit units, the plurality of dodge spaces and the plurality of said first limit units are alternatively arranged around an outer surface of the rotatable member, and the rotatable member is configured to rotate so that one of the plurality of said first limit units corresponds to the at least one second limit unit or one of the plurality of dodge spaces corresponds to the at least one second limit unit, which allows each of the at least one second limit unit to disengageably move into one of the plurality of dodge spaces; the positioning mechanism further includes a projection, the projection is disposed on the second member, the projection includes at least one tooth end portion, each of the at least one tooth end portion extends in the axial direction, a side of each of the at least one first limit unit facing toward the projection includes a groove and a tooth, and the at least one tooth end portion is blockable within the groove or by the tooth alternatively; each of the at least one first limit unit is a protrusion protruding beyond the outer surface of the rotatable member; the groove includes a bevel and a lateral surface transverse to the bevel, each of the at least one tooth end portion is V-shaped, each of the at least one tooth end portion includes two inclined surfaces arranged symmetrically, one of the two inclined surfaces is abutable against the bevel, and the other of the two inclined surfaces is abutable laterally against the lateral surface; the rotatable member includes a through hole, the post is disposed in the through hole, the through hole includes a small diameter section, a larger diameter section and a shoulder between the small diameter section and the larger diameter section, and the elastic member is disposed through the larger diameter section and abutted against the shoulder; the second member includes an elastic arm and a first blocking portion, the elastic arm includes the first blocking portion, the rotatable member includes a second blocking portion, and the first blocking portion and the second blocking portion are disengageably blocked with each other in the axial direction; the second member includes at least one elastic blocking portion, each of the at least one elastic blocking portion is swingable relative to the second member, a side of each of the at least one elastic blocking portion facing away the post includes a blocking member, the base includes a receiving room and a flange, the flange extends to be within the receiving room, each of the at least one elastic blocking portion is disposed in the receiving room, and the blocking member of each of the at least one elastic blocking portion blocked with the flange in the axial direction; the post includes a blocking wall and a recess, the blocking wall and the recess are arranged in the axial direction; when the second member is located in release position, the recess corresponds to the detent member, and the detent member is at least partially received in the recess; when the second member is located in lock position, the blocking wall urges the detent member.

* * * * *